US006864031B2

(12) United States Patent
Ishida et al.

(10) Patent No.: US 6,864,031 B2
(45) Date of Patent: Mar. 8, 2005

(54) ELECTROPHOTOGRAPHIC DEVELOPER AND IMAGE-FORMING METHOD USING THE DEVELOPER

(75) Inventors: Toshihisa Ishida, Kashiba (JP); Tatsuo Imafuku, Nara (JP); Junichi Saito, Nara (JP); Takahiro Bito, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/752,463

(22) Filed: Jan. 5, 2004

(65) Prior Publication Data

US 2004/0142267 A1 Jul. 22, 2004

Related U.S. Application Data

(62) Division of application No. 10/036,184, filed on Dec. 26, 2001, now abandoned.

(30) Foreign Application Priority Data

Dec. 26, 2000 (JP) ..... 2000-395750
Dec. 26, 2000 (JP) ..... 2000-395751

(51) Int. Cl.[7] ..... G03G 15/14

(52) U.S. Cl. ..... 430/126; 430/109.3; 430/110.4; 430/111.34

(58) Field of Search ..... 430/110.4, 109.3, 430/111.34, 111.35, 126

(56) References Cited

U.S. PATENT DOCUMENTS 5,256,512 A 10/1993 Kobayashi et al.
5,447,815 A * 9/1995 Kato et al. ..... 430/108.3

FOREIGN PATENT DOCUMENTS

| | | |
|---|---|---|
| JP | 62-209542 | 9/1987 |
| JP | 01-112253 | 4/1989 |
| JP | 02-000877 | 1/1990 |
| JP | 02/287366 | 11/1990 |
| JP | 03-087752 | 4/1991 |
| JP | 07-261450 | 10/1995 |
| JP | 09-080912 | 3/1997 |
| JP | 09-222747 | 9/1997 |
| JP | 09-288368 | 11/1997 |
| JP | 10-293429 | 4/1998 |
| JP | 2000-047432 | 2/2000 |

* cited by examiner

*Primary Examiner*—John L Goodrow
(74) *Attorney, Agent, or Firm*—David G. Conlin; John B. Alexander; Edwards & Angell, LLP

(57) ABSTRACT

The present invention provides an electrophotographic developer which reduces toner contamination on the surface of a developer carrier even when a development effective range is narrowed and which is stabilized in an image quality in every environmental situation and has a long life and a low cost and an image-forming method using the same.

In the present invention, used for the electrostatically charged-image holder described above having a radius of curvature of 18 mm or less in a development effective range is the electrophotographic developer which is a two-component developer comprising a toner comprising at least a binder and a colorant and a carrier which is coated with a resin and has a weight average particle diameter of 40 to 100 $\mu$m, wherein the above toner has a volume average particle diameter of 8 to 11.5 $\mu$m, and the toner particles having a diameter of 6.35 $\mu$m or less account for 20 number % or less.

8 Claims, 1 Drawing Sheet

ELECTROPHOTOGRAPHIC DEVELOPER AND IMAGE-FORMING METHOD USING THE DEVELOPER

This application is a divisional of Ser. No. 10/036,184 filed Dec. 26, 2001 now abandoned.

BACKGROUND OF THE INVENTION

1. Field of the Invention

The present invention relates to an electrophotographic developer and an image-forming method using the above developer, specifically to an electrophotographic developer which can provide a good image when using an electrostatically charged-image holder (photoreceptor drum) having a small diameter and an image-forming method.

2. Description of the Related Art

In general, in an electrophotography, a toner having a prescribed charging property is developed with a developing unit in order to visualize a latent image formed on a photoreceptor. A toner image is fixed on paper by heating and pressing in a fixing system, whereby a copied image is obtained. In particular, large factors affecting an image quality and a grade of a copied image include a developing step for accurately developing an electrostatic latent image on an electrostatically-charged image holder, a transferring step for transferring the developed developer on a transferred material by means of various transferring devices and a fixing step for fixing the developer on the transferred material. Among them, the developing step is an important step as a first step for visualizing a latent image.

Developers used in a developing step are single component or two component developers, and toners are used for these developers. In recent years, various developing methods have been proposed while advanced are a raise in an image quality, a reduction in a cost and an elongation in a life. A raise in an image quality by a decrease in a particle diameter is proposed in, for example, Registered Japanese Patent Publications No. 2759490, 2759516 and 2763318. Proposed in these patented inventions are techniques to achieve a raise in an image quality by a reduction in a particle diameter of a toner, an inhibition in contamination caused by scattering of toners and maintaining of an image quality and a decrease in contamination in the machine even in use over a long period of time.

A raise in an image quality by a reduction in a particle diameter of a toner which is proposed above is considered to be an effective means for visualizing an electrostatic latent image which is constituted from dots by digitization in recent years. However, a reduction in a particle diameter of a toner makes a production step thereof complicated and therefore leads to production at a high cost. In a crushing method which has so far been used well, a kneaded matter of various toner components is roughly crushed to 1 to 5 mm by a crusher and further finely crushed through a step in which means such as a mechanical system and a collision system are combined, and then it passes through a classifying step such as a flow system, whereby a desired toner particle size is obtained. Usually, it is possible to readily obtain a toner having a volume average particle diameter of 8 to 12 $\mu$m by the crushing method described above, but further measures are required in order to obtain a toner particle size of 12 $\mu$m or less by the above crushing method, and the facilities become complicated. This turns the above method into a method having an inferior productivity and a high cost. Further, a polymerization method is used as a method for obtaining a toner having a small particle diameter, but various organic solvents are used in many cases, and waste water treating facilities therefor, complicated maintenance thereof and the inferior yield turn the above method into high cost production in terms of facilities therefor.

Further, it is very difficult to handle a toner having a small particle diameter because of specific powder characteristics thereof. Brought about are a deterioration in the image caused by the inferior fluidity, particularly a degradation in the fluidity at a high temperature and a high humidity and a reduction in the image density caused by a rise in the charge amount at low temperature and a low humidity. Further, continuing copy-printing in many sheets expedites a rise in the charge amount and causes fusion or adhesion of a toner on a carrier surface. This markedly brings about an inhibition in charging, an increase in contamination in the machine caused by scattering of a toner, a rise in the background density and a deterioration in the image caused by a reduction in the image density and shortens a life of a developer. As described above, a decrease in a particle diameter of a toner makes it possible to raise the image quality for a while but leads to a toner having a high cost and a short developing life. Further, restriction and the construction of a new mechanism are required to the process conditions and the image-forming system themselves, which in turn can not help resulting in elevating a cost required for one sheet of a print.

In recent years, space saving and a reduction in a size of a printing system in a fixing step of a developer on a transferring material are promoted. This allows all parts and units to be inevitably reduced in size. In particular, a reduction in a size in a process (charging, exposing, developing, transferring and removing charge) is important. Among them, more rapid and surer developing is required by reducing a size of the above holder by reducing a radius of curvature in an electrostatically charged-image holder to narrow a mass part (development effective range) where the electrostatically charged-image holder is disposed oppositely to the developer carrier.

Further, an electrostatically charged-image holder and a developer carrier rotate in a developing region in directions reverse to each other in a certain case to carry out development. In this case, troubles are more notably caused if a toner has a short developing time and an inferior developability, and the probability of the troubles results in growing large.

Narrowing of a development effective range strengthens the tendency that a toner having a low charge amount in a developer is selectively developed, so that the toner having a high charge amount remains selectively in the developer or a developing unit. It in turn results in allowing the toner having a relatively large particle diameter to be selectively developed and the toner having a small particle diameter to remain in the developer. That is, remaining of the toner having a small particle diameter contaminates the surface of a toner carrier and brings about an inhibition in charging of the toner in the fresh developer fed, and it in turn causes various kinds of the problems described above.

Usually, the larger the radius of curvature in an electrostatically charged-image holder or a developer carrier and the longer than a distance between the electrostatically charged-image holder and the developer carrier the head distance of the developer, the more the range (development effective range) where the developer comes in contact with the electrostatically charged-image holder can be broadened and the larger the chance in which the developer transfers into the electrostatically charged-image holder and is developed results in growing. Further, the larger the peripheral speed ratio of the developer carrier to the electrostatically charged-image holder, the larger the chance in which the developer transfers into the electrostatically charged-image holder and is developed results in growing as well. However, the more the chance in which the developer is developed is increased, the larger the chance in which the toner transfers from the electrostatically charged-image holder into the developer carrier results in growing.

Accordingly, in order to maintain a developing state well, the electrostatically charged-image holder described above has to be balanced with the developer carrier in terms of a transferring state in a two-way direction.

SUMMARY OF THE INVENTION

An object of the present invention is to provide an electrophotographic developer which reduces toner contamination on the surface of a developer carrier and maintains a charging efficiency in a high state even when narrowed is a mass part (development effective range) where an electrostatically charged-image holder is disposed oppositely to a developer carrier and which is stabilized in an image-quality in every environmental situation and has a long life and a low cost and an image-forming method using the above developer.

Intensive researches repeated by the present inventors in order to achieve the foregoing object in the present invention have resulted in establishing a system in which a good image can be obtained even in a development effective range in an electrostatically charged-image holder having a low radius of curvature and a small diameter by cutting particularly a small diameter mass part of a toner to sharpen a particle size distribution of the toner and obtaining a stable developer having a good charging property.

That is, the electrophotographic developer of the present invention is used in steps where it is fed from a developer carrier to develop an electrostatic latent image on an electrostatically charged-image holder and where the above developed image is transferred onto a transferring material. The electrophotographic developer of the present invention is used for the electrostatically charged-image holder described above which has a radius of curvature of 18 mm or less in a development effective range and which is narrowed in the above development effective range and is a two-component developer comprising a toner comprising at least a binder and a colorant and a carrier which is coated with a resin and has a weight average particle diameter of 40 to 100 $\mu$m, wherein the above toner has a volume average particle diameter of 8 to 11.5 $\mu$m, and the toner particles having a diameter of 6.35 $\mu$m or less account for 20 number % or less.

Further, the electrophotographic developer of the present invention is characterized by that a variation coefficient in toner particle size distribution in terms of number is 35 or less.

Also, the image-forming method of the present invention comprises a step where an electrostatic latent image on an electrostatically charged-image holder is, developed with a developer fed from a developer carrier and a step where the above developed image is transferred onto a transferring material by means of a transferring device. In the image-forming method of the present invention, the electrostatically charged-image holder has a radius of curvature of 18 mm or less in a development effective range; a developer to be used is a two-component developer comprising a toner comprising at least a binder and a colorant and a carrier which is coated with a resin and has a weight average particle diameter of 40 to 100 $\mu$m; the above toner has a volume average particle diameter of 8 to 11.5 $\mu$m; and the toner particles having a diameter of 6.35 $\mu$m or less account for 20 number % or less.

Further, in the image-forming method of the present invention, the developing step described above is characterized by satisfying the following equation:

$$0.12 \leqq \{(Rm+Dsd)\times k\}/(Rd\times T) \leqq 0.35$$

wherein Rm represents a radius (mm) of curvature of the developer carrier; Rd represents a radius (mm) of curvature of the electrostatically charged-image holder in the development effective range; k represents a ratio of a peripheral speed (mm/sec) of the developer carrier to a peripheral speed (mm/sec) of the electrostatically charged-image holder; Dsd represents a minimum proximity distance (mm) between the electrostatically charged-image holder and the developer carrier; and T represents a number % of the toner particles having a diameter of 6.35 $\mu$m or less.

The toner in the respective inventions described above comprises particularly preferably toner particles having a diameter falling in a range of 4.00 to 5.04 $\mu$m in a range of 2 to 6 number % and toner particles having a diameter falling in a range of 5.04 to 6.35 $\mu$m in a range of 2 to 10 number %.

Also, a charging series of the toner in the respective inventions described above has preferably a negative charging property, and the binder of the above toner is preferably a styrene base resin.

Further, particularly preferably, a resin covering the carrier is a silicon resin or the carrier is an iron powder carrier.

Further, the developer of the present invention is suited to an image-forming apparatus in which an electrostatically charged-image holder and a developer carrier rotate in directions reverse to each other in a developing region to carry out development.

In the present invention, restriction of an amount of the toner having a small particle diameter, particularly the toner having a diameter of 6.35 $\mu$m or less makes it possible to inhibit fusion or adhering (spent toner) of the toner onto the developer carrier from being caused and to maintain atoner carrier surface fresh, and it maintains well a charging property of the toner fed and can provide effects of stabilizing the image quality and extending the life of the developer. Further, capable of being provided is an image-forming method particularly preferably used in a printing system in which a stable image quality is provided over a long period of time without being affected by a difference in an environmental situation and a use situation and in which a space is saved at a low running cost.

DESCRIPTION OF THE INVENTION

Figure 1:
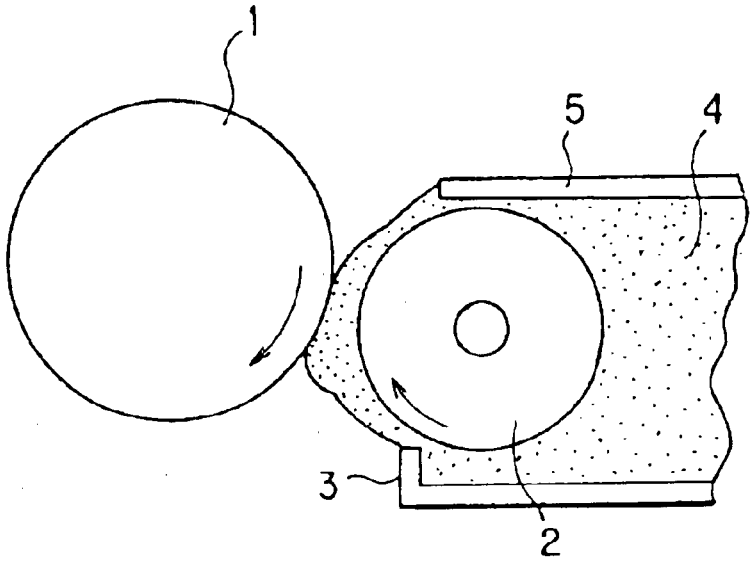
FIG. 1 is a schematic explanatory drawing showing one example of a developing step in an image-forming method using the developer of the present invention.

The embodiment of the present invention shall be described below in details.

The present invention relates to a two component developer comprising a toner and carrier used in a printing system in which a stable image quality is provided over a long period of time without being affected by a difference in an environmental situation and a use situation and in which a space is saved at a low running cost and an image-forming method using the above developer. To be specific, the electrophotographic developer of the present invention comprises the following structural materials.

First, publicly known various resins which are usually used can be used as the binder resin for the toner. To be specific, they include, for example, styrene base resins such as polystyrene, polychlorostyrene, poly-α-methylstyrene, styrene-chlorostyrene copolymers, styrene-propylene copolymers, styrene-butadiene copolymers, styrene-vinyl chloride copolymers, styrene-vinyl acetate copolymers, styrene-acrylic acid copolymers, styrene-acrylate copolymers, styrene-methacrylic acid copolymers, styrene-methacrylate copolymers, styrene-methyl α-chloroacrylate copolymers and styrene-acrylonitrile-acrylate copolymers; vinyl chloride resins; rosin-modified maleic acid resins; phenol resins; epoxy resins; saturated polyester resins; unsaturated polyester resins; polyethylene base resins such as polyethylene and ethylene-ethyl acrylate copolymers; polypropylene resins; ionomer resins; polyurethane resins; silicon resins; ketone resins; xylene resins; polyvinylbutyral resins; and polycarbonate resins. They shall not specifically be restricted.

The styrene base resins described above are homopolymers of styrene or derivatives thereof or copolymer thereof. The styrene-acrylate copolymers include, for example, styrene-methyl acrylate copolymers, styrene-ethyl acrylate copolymers, styrene-butyl acrylate copolymers, styrene-octyl acrylate-copolymers and styrene-phenyl acrylate copolymers. The styrene-methacrylate copolymers include, for example, styrenemethyl methacrylate copolymers, styrene-ethyl methacrylate copolymers, styrene-butyl methacrylate copolymers, styrene-octyl methacrylate copolymers and styrene-phenyl methacrylate copolymers.

Only one kind of these binder resins may be use or two or more kinds thereof may be used in combination. Among the binder resins given above as the examples, the styrene base resins, the saturated polyester resins and the unsaturated polyester resins are preferred, and the styrene base resins are particularly preferred. The production process for the binder resins shall not specifically be restricted.

Publicly known pigments and dyes which are usually used for toners can be used as the colorant. To be specific, the above colorant includes, for example, inorganic pigments such as carbon black, black iron oxide, Prussian blue, chrome yellow, titanium oxide, zinc white, alumina white and calcium carbonate; organic pigments such as phthalocyanine blue, Victoria blue, phthalocyanine green, Malachite Green, Hanza Yellow G, benzidine yellow, lake red C and quinacridone magenta; and organic dyes such as rhodamine base dyes, triallylmethane base dyes, anthraquinone base dyes, monoazo base dyes and diazo base dyes, but they shall not specifically be restricted. Only one kind of these colorants may be used or they may be used in suitable combination according to colors which are to be put on toners. The colorants may be subjected to pretreatment by a publicly known method such as a master batch method. A use amount of the colorants shall not specifically be restricted and falls in a range of preferably 1 to 25 mass parts, more preferably 3 to 20 mass parts per 100 mass parts of the binder resin.

The charge-controlling agent may be negatively chargeable or positively chargeable.

The negatively chargeable agent includes monoazo metal compounds, organic metal compounds, chelating compounds, styrene-acrylic acid copolymers, styrene-methacrylic acid copolymers, aromatic hydroxycarboxylic acids, esters and phenol derivatives such as bisphenols. The positively chargeable agent includes nigrosine base dyes, triphenylmethane base dyes, quaternary ammonium salts, imidazole compounds and metal salts of higher fatty acids. However, they shall not specifically be restricted to them. These charge-controlling agents may be used alone or in combination of plural kinds thereof. A use amount of the charge-controlling agent falls in a range of preferably 0.1 to 20 mass parts, more preferably 0.5 to 10 mass parts per 100 mass parts of the binder resin.

In order to obtain a satisfactory releasing property or peeling property from a fixing roller or a fixing belt, suitably used are synthetic waxes and paraffin waxes and derivatives thereof such as polypropylene and polyethylene, petroleum waxes and modified waxes thereof such as microcrystalline wax and derivatives thereof and plant base waxes such as carnauba wax, rice wax and candelilla wax. High temperature and low temperature offset can be prevented by holding the satisfactory releasing property provided by them. In addition to the structural materials described above, magnetic powder such as metal oxides of iron, magnesium, aluminum, zinc, cobalt, chromium and manganese may be added in a range of 0.5 to 10 mass parts per 100 mass parts of the binder resin.

The mixture of the structural materials described above is molten and kneaded by means of a mixer. The resulting kneaded matter is rolled and cooled by conventionally known methods, roughly crushed, intermediately and finely crushed mechanically or by collision and classified by jet air flow. A toner thus obtained is subjected to particle size measurement by means of a coal tar counter TA-II or a coal tar multisider (manufactured by Coal Tar Co., Ltd.), and as a result thereof, capable of being obtained is a toner in which toner particles having a volume average particle size ($D_{50}v$) of 8 to 11.5 μm and a diameter of 6.35 μm or less accounts for 20 number % or less.

In this case, the toner in which toner particles having a diameter falling in a range of 4.00 to 5.04 μm fall in a range of 2 to 6 number % and in which toner particles having a diameter falling in a range of 5.04 to 6.35 μm fall in a range of 2 to 10 number % displays more the effects of the present invention. If the toner particles having a diameter of 6.35 μm or less do not fall in the range described above, the fine powder toner is fused and adhered onto the carrier surface in many cases, which results in inhibiting the fresh toner fed from being charged.

Further, in order to obtain the effects of the present invention, a variation coefficient which is used as an index showing a width of a toner particle size distribution in terms of number conversion has to be 35 or less. If the toner particle size distribution shows a variation coefficient exceeding 35, the distribution is broad, so that the charging amount distribution is broadened even if the volume average particle diameter falls in a range of 8 to 11.5 μm, and it is difficult to allow the image quality to be compatible with the life of the developer.

In this case, the variation coefficient (number conversion) used as an index showing a width of a toner particle size distribution is obtained from the following equation:

$$\text{variation coefficient} = (\text{standard deviation in number distribution}) / (\text{average particle diameter based on number}) \times 100$$

Next, organic and inorganic fine particles may be dispersed and added onto a toner surface in order to provide the resulting toner particles with functions such as a fluidity and an abrasive property. A use amount of the inorganic fine particles is preferably 0.3 to 5 mass parts per 100 mass parts of the toner.

The organic fine powders include, for example, acrylic resins, polyester resins, fluorine-base resins and styrene base resins.

The inorganic fine powders include, for example, silica fine powder, titanium oxide fine powder and alumina fine powder. In particular, the inorganic fine powder having a specific surface area falling in a range of 90 to 150 $m^2/g$ which is measured by nitrogen adsorption based on a BET method provides good effects.

The inorganic fine powders are preferably treated, if necessary, with a treating agent such as silicon vanishes, various modified silicon vanishes, silicon oils, various modified silicon oils, silane coupling agents, silane coupling agents having functional groups and other organic silicon compounds for the purposes of achieving hydrophobicity and controlling the charging property. Two or more kinds of the treating agents may be used. In particular, the silica-fine powders-subjected to surface treatment with silicon oil are preferred.

Suitably used as the other additives are, for example, lubricants such as teflon, zinc stearate, polyvinylidene fluoride and silicon oil particles (containing about 40% of silica). Further, preferably used is an abrasive such as cerium oxide, silicon carbide, calcium titanate and strontium titanate, and among them, strontium titanate is preferred. Further, a conductivity-providing agent such as zinc oxide, antimony oxide and tin oxide may be used in a small amount using as a developability-improving agent, white fine particles and black fine particles having a polarity reverse to that of the toner particles.

The toner obtained in the manner described above is mixed with iron powder, ferrite, magnetite and resin beads as a carrier at a prescribed mixing percentage and used in the form of a two-component developer. In particular, iron powder is preferably used in order to elevate the effects of the present invention. In the present invention, the carrier has desirably a weight average particle diameter falling in a range of 40 to 100 $\mu$m, preferably 50 to 80 $\mu$m. If the particle diameter is finer than 40 $\mu$m, carrier flying is increased to bring about contamination caused by scattering in the machine and flying of the carrier onto the electrostatically charged-image holder, which results in damaging the above electrostatically charged-image holder. On the other hand, if the carrier has a particle diameter of 100 $\mu$m or more which is larger than the range described above, the head of the developer is hardened to damage the electrostatically charged-image holder to a large extent, so that the electrostatically charged-image holder is decreased in a membrane on the photosensitive layer to a large extent and shortened in a life. In regard to the image quality, an image having a lot of defects is formed.

The carrier used in the present invention is preferably coated on a surface thereof with various resins in order to prevent the toner from being fused and adhered (spent toner) thereon. The coating resin includes resins which are publicly known as coating resins for carrier core particles, such as natural resins, thermoplastic resins, acryl base resins including partially hardened thermosetting resins, silicon base resins and fluorine base resins. Among them, the silicon resins are preferred. The silicon resins exhibit an effect for raising the durability because of a low surface tension and a high water repellency.

Figure 2:
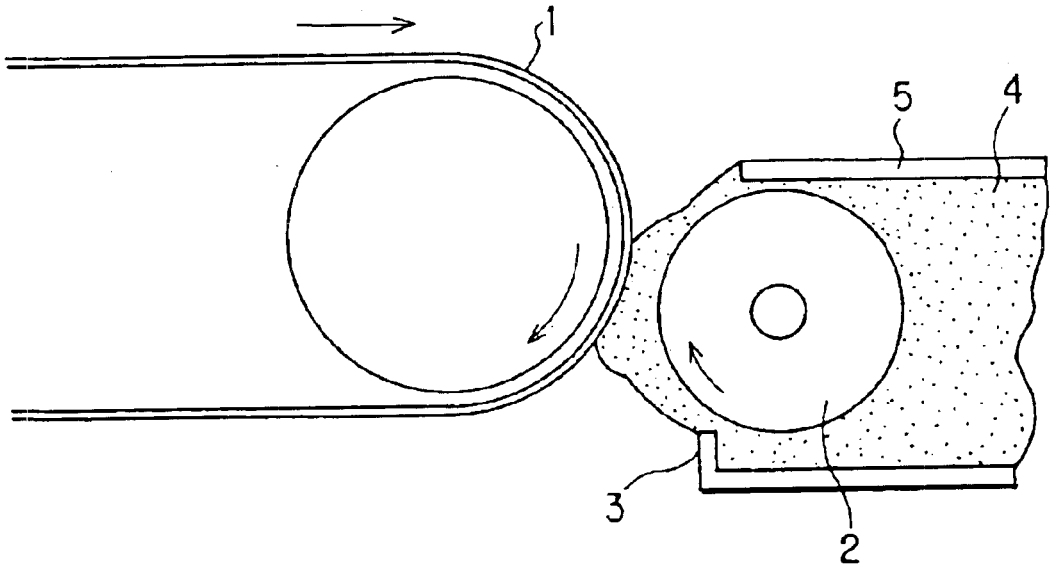
FIG. 2 is a schematic explanatory drawing showing another example thereof.

Next, the image-forming method of the present invention shall be explained according to FIG. 1 and FIG. 2.

As shown in FIG. 1 and FIG., an electrostatically charged-image holder (photosensitive drum or photosensitive belt) 1 is disposed adjacent to a developer carrier 2 in the developing step of the present invention, and they are driven so as to rotate in arrow directions reverse to each other. The developer carrier 2 has a fixed magnet in an internal mass part, and an external surface thereof comprises a magnetic or nonmagnetic blade. Disposed in the circumference of the electrostatically charged-image holder 1 are a (negative) charging unit, an exposing optical system, a transferring (separating) unit, a cleaning unit and a charge-removing unit (all described above are not illustrated) which are known. The developer carrier 2 is located at a tip aperture mass part of a casing 5 communicating with a hopper or a feeding vessel for a developer 4 comprising two components, and the developer 4 is charged and adhered onto the surface thereof.

In this case, the developer carrier 2 on which the developer 4 is charged and adhered is disposed adjacent to the electrostatically charged-image holder 1 while keeping a minimum proximity distance therewith. A controlling board 3 for controlling an amount of the developer is provided at an upstream side in a rotating direction of the developer carrier 2, and the head distance of the developer is controlled by this controlling board 3. In the present invention, the, electrostatically charged-image holder 1 has a radius of curvature of 18 mm or less in a range (development effective range) where the developer 4 carried on the developer carrier 2 while being controlled in such manner comes in contact with the electrostatically charged-image holder 1. An electrostatic latent image is visualized in the developing step using the electrostatically charged-image holder 1 of a photosensitive drum type having a small diameter (FIG. 1) or the electrostatically charged-image holder 1 of a photosensitive belt type (FIG. 2).

Development carried out in a mass part having such a small radius of curvature narrows the development effective range, and in the case where the electrostatically charged-image holder and the developer carrier each moving at a high speed rotate in directions reverse to each other at a high speed in a developing area to carry out development, the developing step itself is of short time and a narrow space, and therefore it is usually difficult to carry out sufficiently the development.

The printing system described above is necessary and indispensable for saving the space and reducing the size while having the problems described above.

In the present invention, use of the electrophotographic developer, particularly the toner of the present invention has made it possible to obtain a printing system in which a stable image quality is provided over a long period of time without having defects such as an image density, a background density, scattering of the toner and flying of the carrier on every environmental condition and use condition and which is reduced in a size at a low running cost.

Further, in the image-forming method of the present invention, attentions have been paid to a radius (mm) of curvature of the developer carrier 2, a radius (mm) of curvature of the electrostatically charged-image holder 1, a ratio of a peripheral speed (mm/sec) of the developer carrier to a peripheral speed (mm/sec) of the electrostatically charged-image holder and a number % of the toner particles having a diameter of 6.35 $\mu$m or less, in which the toner contained in the two-component developer has a volume average particle diameter of 8 to 11.5 $\mu$m, and investigations have further been continued. As a result thereof, it has been found that the problems described above can be overcome by allowing the developing conditions in the developing step in the image-forming apparatus and the toner particles to satisfy the following equation:

$$0.12 \leqq \{(Rm+Dsd)\times k\}/(Rd\times T) \leqq 0.35$$

wherein Rm represents a radius (mm) of curvature of the developer carrier; Rd represents a radius (mm) of curvature of the lectrostatically charged-image holder; k represents a ratio of a peripheral speed (mm/sec) of the developer carrier to a peripheral speed (mm/sec) of the electrostatically charged-image holder; Dsd represents a minimum proximity distance (mm) between the electrostatically charged-image holder and the developer carrier; and T represents a number % of the toner particles having a diameter of 6.35 μm or less.

In this case, a value range shown by the equation described above according to the present invention is 0.12 to 0.35, preferably 0.13 to 0.25.

If the value range in the equation described above is less than 0.12, it is not preferred in terms of that the image density and flying of the carrier on the electrostatically charged-image holder grow large particularly under low temperature and low humidity environment (refer to Comparative Example 2 described later). On the other hand, if the value range in the equation described above is 0.35 or more, it is not preferred in terms of the large background density particularly under low temperature and low humidity environment and contamination caused by scattering of the toner in the vicinity of the mass part under the developer-feeding port in the developing bath (refer to Comparative Toner A described later).

In the present invention, a chance in which developed is the toner transferred from the developer carrier 1 to the electrostatically charged-image holder 2 is well balanced with a chance in which the toner is transferred from the electrostatically charged-image holder 2 to the developer carrier 1 in a two-way transferring state by using the developer and the toner described above and allowing the respective processes and the developing conditions in the image-forming apparatus and the toner particles to satisfy the equation described above, and the excessive toners having a small particle diameter are inhibited from remaining in the developer. Further, as described above, capable of being obtained was a printing system in which a stable image quality is provided over a long period of time without having defects such as an image density, a background density, scattering of the toner and flying of the carrier on every environmental condition and use condition and which is reduced in a size at a low running cost.

EXAMPLES

The present invention shall specifically be explained below with reference to examples.

Judging methods and judging criteria for the image density, the background density, toner scattering and carrier flying which were carried out in the following examples were carried out according to Table 1.

In this case, the image density shown in Table 1 was measured by means of a reflection densitometer (manufactured by Macbeth Co., Ltd.), and the background density was judged by measuring by means of a whiteness meter (manufactured by Nippon Denshoku Kogyo. Co., Ltd.). Toner scattering was evaluated by visually observing the degree of contamination caused by the toner in a mass part under a developer-feeding port in a developing bath. Carrier flying was judged by catching the toner on the electrostatically charged-image holder by means of a pressure-sensitive tape to count the number thereof (number/$cm^2$).

Blending mass part or percentage is based on mass.

TABLE 1

| Evaluation | | Judging criteria | | | |
|---|---|---|---|---|---|
| Items | Judging method | ◎ | ○ | Δ | X |
| Image density | Value measured by Macbeth reflection densitometer | 1.40 or more | 1.30 to 1.39 | 1.20 to 1.29 | Less than 1.20 |
| Background density | Value measured by whiteness meter | Less than 0.70 | 0.70 to 1.00 | 1.01 to 1.19 | 1.20 or more |
| Toner scattering | Visual contamination under developer-feeding port in developing bath | No toner contamination observed over whole area | Slight toner contamination partially observed | Clear toner contamination partially observed | Clear toner contamination observed over whole area |
| Carrier flying | Flying amount of carrier on electrostatically charged-image holder | 0 | 0.1 to 1 | 2 to 10 | 11 or more |

First, various toners (Toners A to G) were produced respectively on the following conditions.

(Toner A)

Mixed with 100 mass parts of a styrene-acryl copolymer as a binder resin by means of a Hoenschell mixer were 2 mass parts of a chrome monoazo dye as a charge-controlling agent, 6 mass parts of carbon black as a colorant and one mass part of polypropylene wax as a releasing agent, and the mixture was molten and kneaded by means of a continuous extruding type kneader and roughly crushed by means of a crusher. Then, it was finely crushed by means of a jet mill to obtain by classification, toner particles in which the toner particles having a volume average particle diameter of 11.0 μm and a diameter of 6.35 μm or less accounted for 12.1 number % and in which a variation coefficient in a toner particle size distribution in terms of number was 29. Then, the toner particles were subjected to surface treatment with 0.5 mass part of hydrophobic silica fine powder to obtain a negatively chargeable toner A.

(Toner B)

A negatively chargeable toner B was obtained in the same manner as in Toner A, except that prepared were the toner particles in which the toner particles having a volume average particle diameter of 8.2 μm and a diameter of 6.35

μm or less accounted for 18 number % and in which the variation coefficient in a toner particle size distribution in terms of number was 25.

(Toner C)

Obtained in the same manner as in Toner A was a negatively chargeable toner C in which toner particles having a volume average particle diameter of 10.5 μm and a diameter of 6.35 μm or less accounted for 13.0 number % and in which a variation coefficient in a toner particle size distribution in terms of number was 28, except that 100 mass parts of a polyester base resin was used as the binder resin.

(Toner D)

Obtained in the same manner as in Toner A was a positively chargeable toner D in which toner particles having a volume average particle diameter of 10.5 μm and a diameter of 6.35 μm or less accounted for 13.0 number % and in which a variation coefficient in a toner particle size distribution in terms of number was 27, except that 2 mass parts of a quaternary ammonium salt was used as the charge-controlling agent.

(Toner E)

A negatively chargeable toner E was obtained in the same manner as in Toner A, except that prepared were the toner particles in which the toner particles having a volume average particle diameter of 12.4 μm and a diameter of 6.35 μm or less accounted for 6.3 number % and the variation coefficient in a toner particle size distribution in terms of number was 37.

(Toner F)

A negatively chargeable toner F was obtained in the same manner as in Toner A, except that prepared were the toner particles in which the toner particles having a volume average particle diameter of 7.7 μm and a diameter of 6.35 μm or less accounted for 30.5 number % and the variation coefficient in a toner particle size distribution in terms of number was 22.

(Toner G)

A negatively chargeable toner G was obtained in the same manner as in Toner A, except that prepared were the toner particles in which the toner particles having a volume average particle diameter of 10.3 μm and a diameter of 6.35 μm or less accounted for 17.5 number % and the variation coefficient in a toner particle size distribution in terms of number was 38.

A volume average particle diameter, a number % and a variation coefficient of Toners A to G are shown together in the following Table 2.

TABLE 2

| Toner No. | Volume average particle diameter (R) (μm) | 4.00 to 5.04 μm number % | 5.04 to 6.35 μm number % | 6.35 μm or less number % | Variation coefficient |
|---|---|---|---|---|---|
| A | 11.0 | 1.9 | 7.0 | 12.1 | 29 |
| B | 8.2 | 4.2 | 11.8 | 18.0 | 25 |
| C | 10.5 | 2.2 | 8.0 | 13.3 | 28 |
| D | 10.5 | 1.9 | 7.9 | 13.0 | 27 |
| E | 12.4 | 1.7 | 3.1 | 6.3 | 37 |
| F | 7.7 | 7.5 | 20.0 | 30.5 | 22 |
| G | 10.3 | 5.3 | 10.1 | 17.5 | 38 |

Toner A

Toner A and an iron powder carrier H which was coated on a surface with a methylsilicon resin and which had a weight average particle diameter of 60 μm were mixed for 20 minutes by means of a Nauter mixer so that the toner concentration became 8%, and the resulting developer was charged into a copying machine (a photoreceptor and a developer carrier rotate in directions reverse to each other in a developing area to carry out development) which was equipped with an electrostatically charged-image holder (photoreceptor) having a radius of curvature of 15 mm and a developer carrier having a radius of curvature of 10 mm and in which a minimum proximity distance between the electrostatically charged-image holder and the developer carrier was 2.0 mm and a ratio of a peripheral speed of the developer carrier to a peripheral speed of the electrostatically charged-image holder was 3.0 to carry out copying of 20,000 sheets at an ordinary temperature and an ordinary humidity (25° C. and 60 RH %), a high temperature and a high humidity (35° C. and 85 RH %) and a low temperature and a low humidity (5° C. and 20 RH %). The respective evaluation items were judged according to Judging criteria shown in Table 1, and the results thereof are shown by every environmental condition in Tables 3 to 5.

The stable results were shown to the image density, the background density, toner scattering and carrier flying on every environmental condition from the beginning through the life end (in copying 20,000 sheets).

The dimensional specifications of the developer carrier and the electrostatically charged-image holder and the values in the relational equation are shown in Table 6 all together with the following examples and comparative examples.

Example 2

A developer was obtained in the same manner as in Example 1, except that Toner B was used, and the same copying test was carried out. The respective evaluation, items were judged according to the judging criteria shown in Table 1, and the results thereof are shown by every environmental condition in Tables 3 to 5.

The stable results were shown to the image density, the background density, toner scattering and carrier flying on every environmental condition from the beginning through the life end (in copying 20,000 sheets).

Example 3

Toner A and a ferrite carrier I which was coated on a surface with an acryl-modified silicon resin and which had a weight average particle diameter of 9.5 μm were mixed for 15 minutes by means of the Nauter mixer so that the toner concentration became 5%, and the resulting developer was charged into a copying machine (a photoreceptor and a developer carrier rotate in directions reverse to each other in a developing area to carry out development) in which a head distance of the developer was controlled to 0.6 mm and a photosensitive belt had a radius of curvature of 18 mm in a developing area where the photosensitive belt was disposed oppositely to a developer carrier, in which the developer carrier had a radius of curvature of 12 mm and in which a minimum proximity distance between the photosensitive belt and the developer carrier was 0.8 mm and a ratio of a peripheral speed of an developer carrier to a peripheral speed of the electrostatically charged-image holder was 2.5, and copying of 20,000 sheets was carried out at an ordinary temperature and an ordinary humidity (25° C. and 60 RH %), a high temperature and a high humidity (35° C. and 85 RH %) and a low temperature and a low humidity (5° C. and 20 RH %). The respective evaluation items were judged according to the judging criteria shown in Table 1, and the results thereof are shown by every environmental condition in Tables 3 to 5.

The stable results were shown to the image density, the background density, toner scattering and carrier flying on every environmental condition from the beginning through the life end (in copying 20,000 sheets).

Example 4

A developer was obtained in the same manner as in Example 3, except that Toner C was used, and the same copying test was carried out. The respective evaluation items were judged according to the judging criteria shown in Table 1, and the results thereof are shown by every environmental condition in Tables 3 to 5.

The stable results were shown to the image density, the background density, toner scattering and carrier flying in every environmental condition from the beginning through the life end (in copying 20,000 sheets).

Example 5

A developer was obtained in the same manner as in Example 1, except that Toner D was used, and the resulting developer was charged into an analog copying machine for a positively chargeable developer (a photoreceptor and a developer carrier rotate in directions reverse in a developing area to each other to carry out development) which was equipped with a photoreceptor drum having a radius of curvature of 15 mm and a developer carrier having a radius of curvature of 12 mm and in which a minimum proximity distance between the electrostatically charged-image holder and the developer carrier was 1.8 mm and a ratio of a peripheral speed of the developer carrier to a peripheral speed of the electrostatically charged-image holder was 3.2 to carry out copying of 20,000 sheets. The respective Devaluation items were judged according to the judging criteria shown in Table 1, and the results thereof are shown by every environmental condition in Tables 3 to 5.

The relatively stable results were shown to the image density, the background density, toner scattering and carrier flying on every environmental condition from the beginning through the life end (in copying 20,000 sheets).

Example 6

A developer was obtained in the same manner as in Example 1, except that Toner G was used, and the same copying test was carried out. The respective evaluation items were judged according to the judging criteria shown in Table 1, and the results thereof are shown by every environmental condition in Tables 3 to 5.

The relatively stable results were shown to the image density, the background density, toner scattering and carrier flying on every environmental condition from the beginning through the life end,(in copying 20,000 sheets).

Comparative Example 1

A developer was obtained in the same manner as in Example 1, except that Toner E was used, and the same copying test was carried out. The respective evaluation items were judged according to the judging criteria shown in Table 1, and the results thereof are shown by every environmental condition in Tables 3 to 5.

The background density and toner scattering grew large on a high temperature and high humidity condition from the beginning through the life end (in copying 20,000 sheets), and contamination in the machine (particularly a mass part under a developing bath) after copying 20,000 sheets was heavy.

Comparative Example 2

A developer was obtained in the same manner as in Example 1, except that Toner F was used, and the same copying test was carried out. The respective evaluation items were judged according to the judging criteria shown in Table 1, and the results thereof are shown by every environmental condition in Tables 3 to 5.

The image density was lowered on allow temperature and low humidity condition from the beginning through the life end (in copying 20,000 sheets).

Comparative Example 3

A developer was obtained in the same manner as in Example 1, except that non-coated iron powder J having a weight average particle diameter of 35 $\mu$m which was not coated on a surface with a resin was used as the carrier, and the same copying test was carried out. The respective evaluation items were judged according to the judging criteria shown in Table 1, and the results thereof are shown by every environmental condition in Tables 3 to 5.

The image density was lowered on a low temperature and low humidity condition from the beginning through the life end (in copying 20,000 sheets). Further, carrier flying to the photoreceptor was caused, and the surface of the photoreceptor after copying 20,000 sheets was severely scratched.

Comparative Example 4

A developer was obtained in the same manner as in Example 3, except that a non-coated ferrite carrier K having a weight average particle diameter of 110 $\mu$m which was not coated on a surface with a resin was used as the carrier, and the same copying test was carried out. The respective evaluation items were judged according to the judging criteria shown in Table 1, and the results thereof are shown by every environmental condition in Tables 3 to 5.

The background density and toner scattering grew large on a high temperature and high humidity condition from the beginning through the life end (in copying 20,000 sheets), and contamination in the machine (particularly a mass part under a developing bath) after copying 20,000 sheets was heavy.

Reference Example 1

A developer was obtained in the same manner as in Example 1, except that the developer was charged into a copying machine (a photoreceptor and a developer carrier rotate in directions reverse in a developing area to each other to carry out development) which was equipped with an electrostatically charged-image holder having a radius of curvature of 18 mm and a developer carrier having a radius of curvature of 8 mm and in which a minimum proximity distance between the electrostatically charged-image holder and the developer carrier was 0.5 mm and a ratio of a peripheral speed of the developer carrier to a peripheral speed of the electrostatically charged-image holder was 2.2, and the same copying test was carried out. The respective evaluation items were judged-according to the judging criteria shown in Table 1, and the results thereof are shown by every environmental condition in Table 6. It can be found that a value in the following equation does not reach 0.12 in Reference Example 1 described above and therefore evaluation in the life end is worsened. The image density, the background density, toner scattering and carrier flying resulted in falling outside the specifications on the respective environmental conditions.

$$\{(Rm+Dsd)\times k\}/(Rd\times T)=(8+0.5)\times 2.2/(18\times 12.1)=0.09$$

TABLE 3

Ordinary temperature and ordinary humidity (25° C., 60 RH %)

| Example/Comparative | Example | | | | | | Comparative Example | | | | Reference Example |
|---|---|---|---|---|---|---|---|---|---|---|---|
| Example | 1 | 2 | 3 | 4 | 5 | 6 | 1 | 2 | 3 | 4 | 1 |
| Image density | | | | | | | | | | | |
| Beginning | ◎ | ◎ | ◎ | ◎ | ◎ | ◎ | ◎ | ○ | ○ | ◎ | ◎ |
| Life end | ◎ | ○ | ○ | ○ | ○ | ○ | ◎ | Δ | ○ | ○ | Δ |
| Background density | | | | | | | | | | | |
| Beginning | ◎ | ◎ | ◎ | ◎ | ○ | ○ | ○ | ◎ | ◎ | ○ | ◎ |
| Life end | ◎ | ◎ | ◎ | ○ | ○ | ○ | ○ | ○ | ○ | Δ | X |
| Toner scattering | | | | | | | | | | | |
| Beginning | ◎ | ◎ | ◎ | ◎ | ◎ | ◎ | ○ | ◎ | ◎ | ◎ | ◎ |
| Life end | ◎ | ◎ | ○ | ○ | ○ | ○ | Δ | ○ | ○ | Δ | X |
| Carrier flying | | | | | | | | | | | |
| Beginning | ◎ | ◎ | ◎ | ◎ | ◎ | ◎ | ◎ | ◎ | ○ | ◎ | ◎ |
| Life end | ◎ | ○ | ○ | ○ | ◎ | ◎ | ○ | Δ | Δ | ○ | X |

TABLE 4

High temperature and high humidity (35° C., 85 RH %)

| Example/Comparative | Example | | | | | | Comparative Example | | | | Reference Example |
|---|---|---|---|---|---|---|---|---|---|---|---|
| Example | 1 | 2 | 3 | 4 | 5 | 6 | 1 | 2 | 3 | 4 | 1 |
| Image density | | | | | | | | | | | |
| Beginning | ◎ | ◎ | ◎ | ◎ | ◎ | ◎ | ◎ | ○ | ◎ | ◎ | ○ |
| Life end | ◎ | ○ | ◎ | ◎ | ○ | ○ | ◎ | Δ | X | Δ | X |
| Background density | | | | | | | | | | | |
| Beginning | ◎ | ◎ | ○ | ○ | ○ | ○ | X | ◎ | X | Δ | X |
| Life end | ◎ | ◎ | ○ | ○ | ○ | ○ | X | ○ | Δ | X | X |
| Toner scattering | | | | | | | | | | | |
| Beginning | ◎ | ◎ | ◎ | ○ | ◎ | ○ | Δ | ◎ | ○ | ○ | ○ |
| Life end | ◎ | ◎ | ○ | ○ | ○ | ○ | X | ○ | Δ | X | X |
| Carrier flying | | | | | | | | | | | |
| Beginning | ◎ | ◎ | ◎ | ◎ | ◎ | ◎ | ◎ | ○ | ◎ | ○ | ○ |
| Life end | ◎ | ○ | ○ | ○ | ○ | ○ | ○ | Δ | ○ | ○ | X |

TABLE 5

Low temperature and low humidity (5° C., 20 RH %)

| Example/Comparative | Example | | | | | | Comparative Example | | | | Reference Example |
|---|---|---|---|---|---|---|---|---|---|---|---|
| Example | 1 | 2 | 3 | 4 | 5 | 6 | 1 | 2 | 3 | 4 | 1 |
| Image density | | | | | | | | | | | |
| Beginning | ◎ | ○ | ◎ | ○ | ○ | ◎ | ○ | X | ◎ | ○ | ○ |
| Life end | ◎ | ○ | ○ | ○ | ○ | ○ | ○ | X | X | X | X |
| Background density | | | | | | | | | | | |
| Beginning | ◎ | ◎ | ◎ | ◎ | ○ | ○ | Δ | ◎ | Δ | ○ | ○ |
| Life end | ◎ | ◎ | ◎ | ○ | ○ | ○ | ○ | ○ | ○ | ○ | Δ |

TABLE 5-continued

| Low temperature and low humidity (5° C., 20 RH %) | | | | | | | | | | | |
|---|---|---|---|---|---|---|---|---|---|---|---|
| Example/Comparative | Example | | | | | | Comparative Example | | | | Reference Example |
| Example | 1 | 2 | 3 | 4 | 5 | 6 | 1 | 2 | 3 | 4 | 1 |
| Toner scattering | | | | | | | | | | | |
| Beginning | ◎ | ◎ | ◎ | ◎ | ◎ | ◎ | ○ | ◎ | ○ | ◎ | ○ |
| Life end | ◎ | ○ | ○ | ○ | ○ | ○ | Δ | ○ | ○ | ○ | X |
| Carrier flying | | | | | | | | | | | |
| Beginning | ◎ | ◎ | ○ | ◎ | ◎ | ◎ | ◎ | Δ | ◎ | ○ | ○ |
| Life end | ◎ | ○ | ○ | ○ | ○ | ○ | ○ | X | X | X | X |

TABLE 6

| Example/ Comparative Example | Rm (mm) | Rd (mm) | Dsd (mm) | k | T (number %) | {(Rm + Dsd) × k}/ (Rd × T) |
|---|---|---|---|---|---|---|
| Example 1 | 10 | 15 | 2.0 | 3.0 | 12.1 | 0.20 |
| Example 2 | 10 | 15 | 2.0 | 3.0 | 18.0 | 0.13 |
| Example 3 | 12 | 18 | 0.8 | 2.5 | 12.1 | 0.15 |
| Example 4 | 12 | 18 | 0.8 | 2.5 | 13.3 | 0.13 |
| Example 5 | 12 | 15 | 1.8 | 3.2 | 13.0 | 0.23 |
| Example 6 | 10 | 15 | 2.0 | 3.0 | 17.5 | 0.14 |
| Comparative Example 1 | 10 | 15 | 2.0 | 3.0 | 6.3 | 0.38 |
| Comparative Example 2 | 10 | 15 | 2.0 | 3.0 | 30.5 | 0.08 |
| Comparative Example 3 | 10 | 15 | 2.0 | 3.0 | 12.1 | 0.20 |
| Comparative Example 4 | 12 | 18 | 0.8 | 2.5 | 12.1 | 0.15 |
| Reference Example 1 | 8 | 18 | 0.5 | 2.2 | 12.1 | 0.09 |

According to the present invention, a chance in which developed is the toner transferred from the developer carrier to the electrostatically charged-image holder is well balanced with a chance in which the toner is transferred from the electrostatically charged-image holder to the developer 1 carrier in a two-way transferring state by using the electrophotographic developer of the present invention described above. Further, the excessive toners having a small particle diameter were inhibited from remaining in the developer, and capable of being obtained was an image-forming method by a printing system in which a stable image quality is provided over a long period of time on every environmental condition and use condition and which is reduced in a size at a low running cost.

What is claimed is:

1. An image-forming method comprising a step where an electrostatic latent image on an electrostatically charged-image holder is developed with a developer fed from a developer carrier and a step where the above developed image is transferred onto a transferring material, wherein the above electrostatically charged-image holder has a radius of curvature of 18 mm or less in a development effective range; the above developer is a two-component developer comprising a toner comprising at least a binder and a colorant and a carrier which is coated with a resin and has a weight average particle diameter of 40 to 100 μm; the above toner has a volume average particle diameter of 8 to 11.5 μm; and the toner particles having a diameter of 6.35 μm or less account for 20 number % or less, and wherein the developing step described above satisfies the following equation:

$$0.12 \leqq \{(Rm+Dsd)\times k\}/(Rd\times T) \leqq 0.35$$

wherein Rm represents a radius (mm) of curvature of the developer carrier; Rd represents a radius (mm) of curvature of the electrostatically charged-image holder in the development effective range; k represents a ratio of a peripheral speed (mm/sec) of the developer carrier to a peripheral speed (mm/sec) of the electrostatically charged-image holder; Dsd represents a minimum proximity distance (mm) between the electrostatically charged-image holder and the developer carrier; and T represents a number % of the toner particles having a diameter of 6.35 μm or less.

2. The image-forming method as described in claim 1, wherein the electrostatically charged-image holder and the developer carrier rotate in directions reverse to each other in the development effective range described above.

3. The image-forming method as described in claim 1 or claim 2, wherein a variation coefficient in toner particle size distribution in terms of number is 35 or less.

4. The image-forming method as described in claim 1 or claim 2, wherein used is the toner described above comprising toner particles having a diameter falling in a range of 4.00 to 5.04 μm in a range of 2 to 6 number % and toner particles having a diameter falling in a range of 5.04 to 6.35 μm in a range of 2 to 10 number %.

5. The image-forming method as described in claim 1 or claim 2, wherein used is the developer in which a charging series of the toner described above has a negative charging property.

6. The image-forming method as described in claim 1 or claim 2, wherein the binder contained in the toner described above is a styrene base resin.

7. The image-forming method as described in claim 1 or claim 2, wherein the carrier described above is an iron powder carrier.

8. The image-forming method as described in claim 1 or claim 2, wherein the resin coating the carrier described above is a silicon resin.

* * * * *